United States Patent [19]

Bomers

[11] 4,135,475

[45] Jan. 23, 1979

[54] APPARATUS FOR APPLYING LIQUID TO SHEETLIKE MATERIAL

[75] Inventor: Johannes P. Bömers, Grubbenvorst, Netherlands

[73] Assignee: Océ-van der Grinten N.V., Venlo, Netherlands

[21] Appl. No.: 845,596

[22] Filed: Oct. 26, 1977

[30] Foreign Application Priority Data

Oct. 29, 1976 [NL] Netherlands ..... 7611988

[51] Int. Cl.[2] ..... B05C 1/08

[52] U.S. Cl. ..... 118/249; 29/125; 29/129; 118/262; 118/DIG. 15

[58] Field of Search ..... 29/125, 129; 118/249, 118/DIG. 15, 262; 354/318

[56] References Cited

U.S. PATENT DOCUMENTS

| | | | |
|---|---|---|---|
| 2,604,128 | 7/1952 | Deck et al. | 29/129 X |
| 3,648,342 | 3/1972 | Dorfel | 29/125 |
| 3,786,975 | 1/1974 | Heymanns | 29/125 X |
| 4,068,620 | 1/1978 | Peters | 118/262 X |

*Primary Examiner*—John McIntosh
*Attorney, Agent, or Firm*—Albert C. Johnston

[57] ABSTRACT

A pressure roller for applying pressure to a sheet-like material passing between the pressure roller and an application roller for applying a layer of liquid to the material, as in the development of diazotype copies, comprises a plurality of relatively short constituent rollers connected to one another by connecting means which permit radial displacement of the adjacent constituent rollers relative to each other and wherein each constituent roller is urged toward the application roller by at least one resilient spring-like element. The pressure roller thus enables contact between it and the application roller with an even pressure, without significant sagging along its length, while allowing uneven areas of the sheet-like material to pass therebetween without affecting the force exerted over the entire nip between the rollers. Improved development of diazotype copies can thus be obtained.

9 Claims, 3 Drawing Figures

APPARATUS FOR APPLYING LIQUID TO SHEETLIKE MATERIAL

This invention relates to an apparatus for the application of a layer of liquid to a sheetlike material, such as a sheet or web of the material, which is provided with a liquid-application roller, a means for supplying liquid to the application roller, a pressure roller for pressing the sheetlike material against the application roller, and means for supplying the sheetlike material and conveying it through the apparatus.

Such apparatus finds utility in the development of diazotype copies, and is known, as seen, for example, in copending U.S. Pat. No. 4,068,620 and assigned to the assignee of the present application. That application describes a developing apparatus including an application roller covered with a rubber sleeve and a profiled pressure roller cooperating therewith and providing certain described advantages. However, where comparatively large roller working widths are required, such as those usually encountered in the diazotype developing process, an apparatus such as that described in the co-pending patent application exhibits the disadvantage that forces applied to a sheet or web of diazo material are not equal over the full length of the nip between the application roller and the pressure roller because of sagging of the rollers. This is particularly the case with the process described in the co-pending patent application for developing diazotype copies with not more than 4.5 cubic centimeters of developing liquid applied per square meter of material since small differences in nip pressure can result in the formation of developed and undeveloped image areas on the diazotype copy.

One solution for this problem can be seen in the journal "Science et Industrie Photographique" 25 (1954) No. 12. That journal discloses a device for applying a layer of liquid to sheetlike material, which device includes two parallel rollers partially immersed in the liquid to be applied and a pressure roller which at the same time functions as an aplication roller, and which is in contact with and supported on the two immersed rollers. In order to ensure a good contact between the pressure roller and the two other rollers, one of the proposals describes providing the pressure roller in the form of a plurality of shorter rollers which are connected with each other by, for example, a rubber layer. Yet, it is apparent that while this proposal results in a good roller contact in the embodiment shown in the journal, it aggravates rather than solves the problem with an apparatus such as shown in the co-pending application referred to above, where the profiled pressure roller is supported only at its ends. The same applies to another proposal described in the journal, namely to apply extra force to the center of the pressure roller to obtain a better roller contact.

The object of this invention is the provision of an apparatus for bringing two rollers in contact with each other with an even pressure while overcoming the disadvantages mentioned above. This is achieved, according to the invention, by a pressure roller comprising a plurality of constituent or partial rollers connected to one another by connecting means which permit radial displacement of the adjacent constituent rollers relative to each other, and wherein each constituent roller is urged yieldably toward the application roller by at least one resilient or spring-like element.

Thus, in this invention, all the constituent rollers together behave as one pressure roller toward the sheetlike material. At the same time, with regard to sagging, the pressure roller can be considered as comprising a succession of cooperating individual pressure rollers, each of which is without significant sagging. In this way, not only does one achieve constant contact pressure per constituent roller over the nip length, but also the force is substantially constant over the entire nip length.

Preferably a resilient or spring-like element is used near an end of each constituent roller. Thus, one such resilient element can be used for applying force to the adjacent ends of two adjacent constituent rollers and will urge them both toward the application roller so that any pressure variation arising as a result of difference in the force applied by successive resilient elements is distributed over the length of two constituent rollers.

The above mentioned and other objects, features and advantages of the invention will be further apparent from the following description and the accompanying drawings of an illustrative embodiment of the invention. In the drawings.

Figure 1:
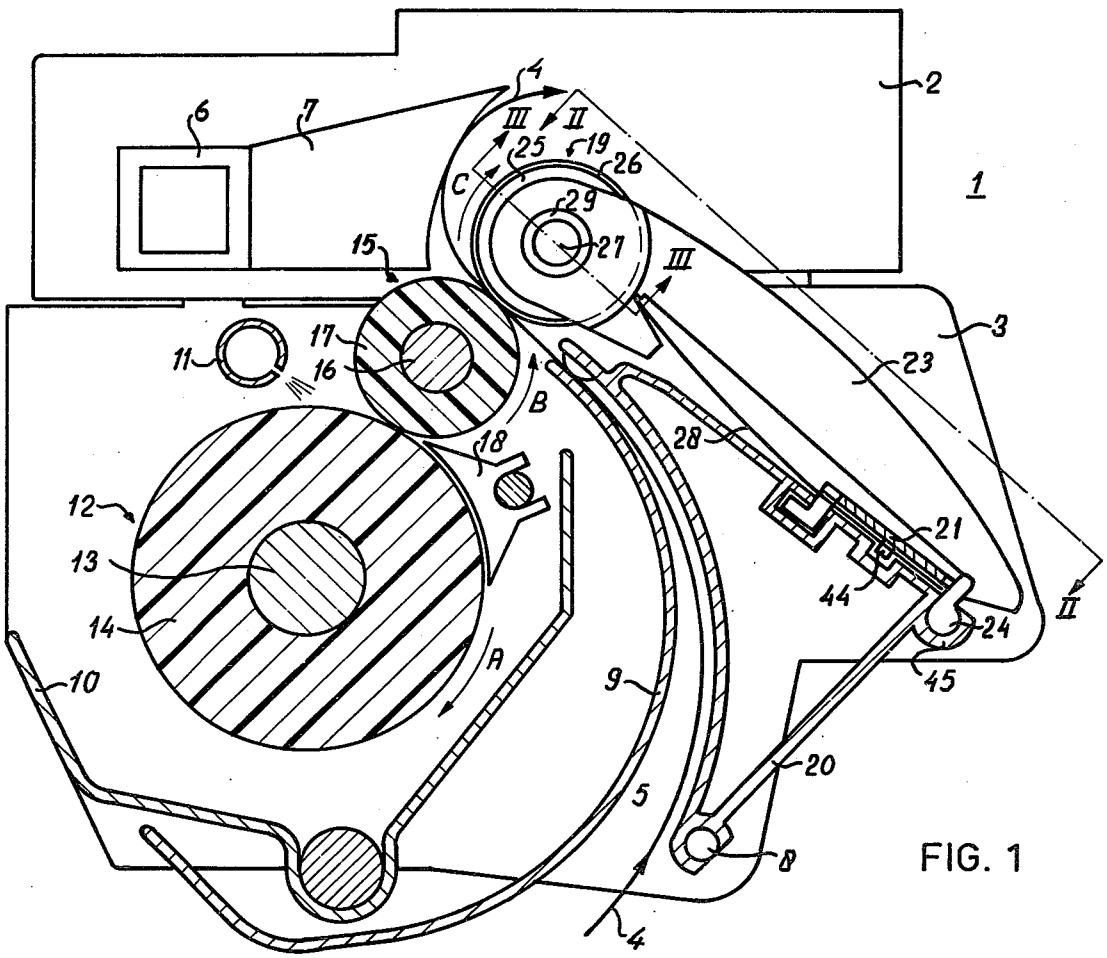
FIG. 1 is a cross-sectional view of a developing unit of a diazo copying apparatus embodying the invention.

As shown in FIG. 1, a developing unit 1 of a diazo copying apparatus embodying the invention is positioned between two sets of frameplates, which include frameplates 2 and 3 at one side of the developing unit and a similar set of frameplates (not shown) at the other side of the developing unit. A dosing roller 12 and an application roller 15 of the developing unit are supported in bearings in the frameplates and are driven, as may be required, by suitable known drive means (not shown), for instance by chains and chain gears. The stationary parts of the developing unit are fixed to the frameplates by suitable known means, such as angle supports (not shown).

The developing unit 1 comprises an entrance channel or path 5 through which the sheetlike diazomaterial is conveyed in the direction indicated by the arrow 4 to the nip between the application roller 15 and a pressure roller 19. The entrance channel or path 5 is formed by a guide element 9 and a side wall of a hollow torsion support 20, and progressively decreases in height along the path in the direction of movement of the diazomaterial. After the diazomaterial has passed the nip between the application roller 15 and the pressure roller 19, with its side to be developed directed toward the application roller, the material is turned in direction by curved guiding elements 7 fixed on a hollow support element 6, so that the material then passes over the below-described elements 23 and into a receiving tray (not shown), or into another apparatus for further handling.

Developing liquid is supplied to the dosing roller 12 of the developing unit 1 by a spraying unit 11. The developing liquid so supplied in excess of the quantity dosed by the dosing roller 12 drains into a receiving trough 10 and thence to a reservoir (not shown). The dosing roller 12 comprises a metal core 13 inside a plastic sleeve 14 the periphery of which is provided with a spiral-like groove having a depth up to about 20 microns. The dosing roller 12 transfers the developing liquid to the application roller 15, which comprises a metal core 16 and a smooth rubber sleeve 17. Developing liquid tending to accumulate toward the ends of the roller 12 is drained off into the receiving trough 10 via channels (not shown) in limiting elements 18 provided at both ends of the roller 12. These limiting elements are described in U.S. Pat. No. 3,995,585.

The pressure roller 19 is a profiled roller which presses against the application roller 15 and has a surface profile illustrated schematically at 26. The rollers 12, 15 and 19 respectively rotate in the directions represented by the arrows A, B and C.

The quantity of developing liquid applied to the diazomaterial by the application roller 15 depends, as described in U.S. Pat. No. 4,043,816, on the surface texture of the dosing roller 12, the hardness and the hydrophilic character of the surface of the application roller 15, the pressure between the dosing roller 12 and the application roller 15 and the pressure between the application roller 15 and the pressure roller 19. These parameters are adjusted relative to each other so that a liquid application of between 1.5 and 4.5 cubic centimeters per square meter of diazomaterial is obtained. It will be apparent that a large number of suitable combinations is possible.

The pressure roller 19 comprises a plurality of adjacent, relatively short constituent, or partial, rollers held together substantially in axial alignment. Each of the constituent rollers, for example, has a length of approximately 10 cm. Two of these rollers are partially shown and are indicated by reference numerals 25 and 30 in FIG. 3, in which a preferred means according to the invention for interconnecting the constituent rollers is also illustrated.

Figure 3:
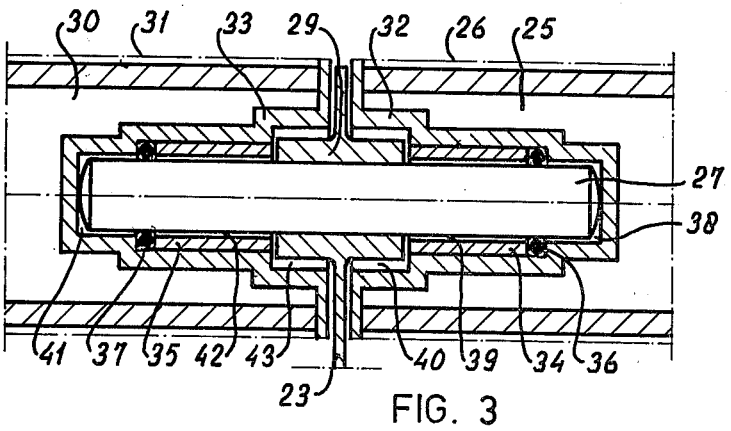
FIG. 3 is a longitudinal sectional view of such connecting means, taken along the line III—III in FIG. 1.

The surface of each of the constituent rollers preferably is formed by a multiplicity of knurled rings surrounding a roller body, as described in U.S. Pat. No. 4,068,620. The knurls form profiles having a cylindrical outline indicated at 26 and 31. The adjacent ends of the adjacent constituent rollers, as shown for rollers 25 and 30 in FIG. 3, are each provided with an end opening, and respective bushings 32 and 33 fit into these openings and define confronting axial recesses in the adjacent roller ends. The bushings 32 and 33 preferably are identical, and each of them preferably has an end flange formed peripherally with a series of knurls which correspond to the knurls of said rings and form part of the profiles 26 and 31.

The bushing 32 comprises three successive substantially cylindrical wall portions 38, 39 and 40 stepped at increasing diameters. The same applies to the portions 41, 42 and 43 of the bushing 33. The confronting bushings receive similarly portions of a connecting stub shaft 27, which preferably is a smooth metal bar of cylindrical form. A shaft 27 extends between and interconnects each two adjacent constituent rollers in the manner shown for the rollers 25 and 30.

The shaft 27 has a length slightly greater than twice the axial depth of the bushing 32 so that, with the ends of the shaft abutting the end walls of the bushings, a small space is provided between the bushing flanges at the ends of the rollers 25 and 30. The diameter of the shaft 27 is smaller than the diameter of the smaller bushing portions 38, 41, and the shaft 27 is connected with the bushings 32 and 33, so with the respective rollers 25 and 30, by means of 0-rings 36 and 37, respectively. The 0-rings 36 and 37 are installed in respective bushing portions 39 and 42 and are kept in place by retaining bushings 34 and 35, respectively, which fit tightly in the bushing portions 39 and 42 and are larger in inside diameter than the outside diameter of the shaft 27. The bushings 32, 33, 34 and 35 preferably are made of plastic.

Figure 2:
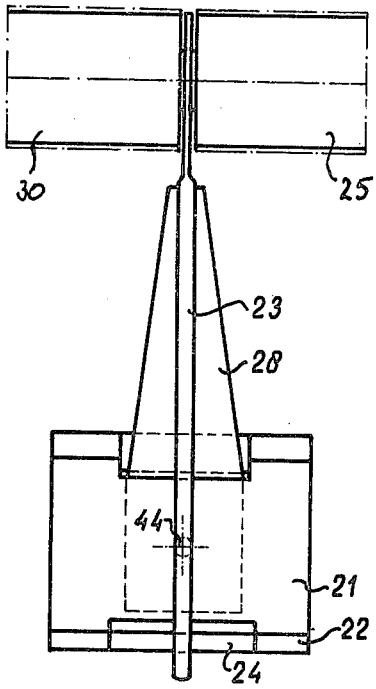
FIG. 2 is a plan view taken along the line II—II in FIG. 1, showing a resilient element engaged with a part of the connecting means for two constituent rollers.

As shown in FIGS. 1 and 2, an arm 23, also preferably made of plastic, is provided at one end with a sleeve bearing 29 in which the shaft 27 can rotate suitably. The bearing 29 fits loosely in the space defined by the confronting larger recessed portions 40 and 43 of the adjacent roller ends. As already described, only the 0-rings 36 and 37 connect the shaft 27 with the rollers 25 and 30. An end portion of the arm 23 near the bearing 29 is made thin enough to fit freely in the space between the end faces of the rollers 25 and 30, as seen in FIGS. 2 and 3, yet is sufficiently thick and wide in body that the force required for pressing the constituent rollers 25 and 30 against the application roller 15 can be applied through the arm 23 from a blade spring 28 to the shaft 27 and thence via the 0-rings 36 and 37 to the ends of the rollers 25 and 30.

The blade spring 28 is located beneath the arm 23. It has a narrow forward end which is notched to engage with a notched portion of the arm 23 near the rollers 25 and 30 (FIG. 1), thus fixing the end of the blade spring 28 relative to the arm 23. A broad backward end of the blade spring 28 extends beneath a support plate 21 and is fixed to it by engagement with a locking projection 44 on the support plate. The support plate 21 is provided with bearing portions 22 at its backward end, and the arm 23 is provided similarly with bearing portion 24. The bearing portions 22 and 24 are engaged in a groove 45 formed on the hollow torsion support 20. The hollow torsion support 20 is fixed on the frameplates by corner supports (not shown) and bar ends 8. The hollow support 20 is made of plastic and exhibits a high torsion stiffness as a result mainly of its triangular shape.

The broad end of the blade spring 28 is clamped between the plate 21 and the torsion support 20 which holds this end fixed relative to the application roller 15. The narrow end of the blade spring 28 exerts a force on the arm 23 in the direction toward the application roller 15, which force is transmitted through the arm bearing 29 to the shaft 27 and from this shaft through the 0-rings 36 and 37 to the bushings fixed in the ends of the rollers 25, 30. Since the shaft 27 has some play in the radial direction in the bushings 32, 33, 34 and 35, the ends of the connected rollers 25 and 30 can be moved radially relative to each other.

This radial movability allows thickenings in the diazomaterial, such for instance as thicker portions occurring at creases, to pass between the rollers 15 and 19 without causing a reduction of the force of the entire pressure roller on the diazomaterial in the nip. Such a force reduction could cause portions of the material to be undeveloped or improperly developed. Another advantage is also achieved in that the relatively short constituent rollers which together constitute the pressure roller can rotate reasonably freely relative to each other.

I claim:

1. In an apparatus for applying a layer of liquid to sheetlike material, including a liquid application roller, means for supplying liquid to the application roller, a pressure roller for pressing the sheetlike material against the application roller and means for guiding sheetlike material to and from the nip between said rollers, the improvement wherein the pressure roller comprises a plurality of relatively short, axially aligned constituent rollers each disposed adjacent to at least one other and each rotatable independently of the others, means connecting together the respective adjacent ends of adjacent constituent rollers so as to keep them substantially coaxial yet permitting displacement of them relative to each other in radial direction and resilient means acting upon each said connecting means for yieldably urging said ends of adjacent constituent rollers toward the application roller.

2. Apparatus according to claim 1, said adjacent roller ends each having an axial recess therein, each said connecting means comprising a shaft located in the respective recesses of and extending between said adjacent roller ends and means yieldably connecting said shaft in each of said recesses with the respective roller end.

3. Apparatus according to claim 2, each said recess and said shaft being substantially cylindrical.

4. Apparatus according to claim 2, each said yieldably connecting means comprising an 0-ring confined between said shaft and a surrounding roller wall portion in the respective recess.

5. Apparatus according to claim 2, each said resilient means including a spring element and an arm urged by said spring element in the direction toward said application roller, said arm having an end portion extending between said adjacent roller ends and carrying thereon a bearing portion which protrudes into said recesses and in which said shaft is held rotatably.

6. Apparatus according to claim 2, each of said constituent rollers having a profiled surface constituted by a patterned myriad of protruding knurls, each of said recesses being defined by a bushing fitted into an axial opening in a constituent roller and each said bushing comprising a radial annular flange formed peripherally with knurls fitting the pattern of the knurls of said surface.

7. Apparatus according to claim 2, each of said recesses being defined by a bushing having three successive substantially cylindrical wall portions stepped at different diameters, an end portion of said shaft extending through an 0-ring confined in the said wall portion of intermediate diameter and into the said wall portion of smallest diameter, said 0-ring being confined in place by a retaining ring of greater inside diameter than the outside diameter of said shaft, each said resilient means comprising a blade spring having one end thereof fixed relative to said application roller and having on its other end an arm of which an end portion lies transverse to the plane of said spring and is sufficiently thin to fit freely between said adjacent roller ends, said arm end portion carrying thereon a sleeve bearing which is slidably engaged upon a midportion of said shaft and which protrudes freely into the respective wall portions of largest diameter of said recesses of adjacent roller ends.

8. Apparatus according to claim 7, each of said constituent rollers comprising a substantially cylindrical roller body having a multiplicity of knurled rings fitted thereon to form a profiled roller surface, each said bushing having a radial flange overlying an end of the related roller body and formed circumferentially with a series of knurls which correspond to the knurls of said rings.

9. In an apparatus for applying a layer of liquid to sheetlike material, including a liquid application roller, means for supplying liquid to the application roller, a pressure roller for pressing the sheetlike material against the application roller and means for guiding sheetlike material to and from the nip between said rollers, the improvement wherein the pressure roller comprises a plurality of relatively short, axially aligned constituent rollers each disposed adjacent to at least one other, means connecting together the respective adjacent ends of adjacent constituent rollers so as to keep them substantially coaxial yet permitting displacement of them relative to each other in radial direction and resilient means acting upon each said connecting means for yieldably urging said ends of adjacent constituent rollers toward the application roller, each said constituent roller being rotatable independently relative to the others;

said adjacent roller ends each having an axial recess therein, said connecting means comprising for each two adjacent roller ends a substantially cylindrical shaft located in the respective recesses of and extending between such roller ends and means, including an 0-ring confined between said shaft and surrounding roller wall portion, yieldably connecting said shaft in each of said recesses with the respective roller end;

said resilient means comprising for each said shaft a spring element and an arm urged by said spring element in the direction toward said application roller, said arm having an end portion extending between the respective adjacent roller ends and carrying thereon a bearing portion which protrudes into the respective recesses of the roller ends and in which the related shaft is held rotatably.

* * * * *